US006099999A

United States Patent [19]

Takenaka et al.

[11] Patent Number: 6,099,999

[45] Date of Patent: Aug. 8, 2000

[54] BINDER CARRIER COMPRISING MAGNETIC PARTICLES AND SPECIFIC RESIN

[75] Inventors: Koichi Takenaka, Itami; Makoto Kobayashi, Kobe; Tomoharu Nishikawa, Hirakata; Hideaki Yasunaga, Nishinomiya; Hiroyuki Fukuda, Sanda, all of Japan

[73] Assignee: Minolta Co., Ltd., Osaka, Japan

[21] Appl. No.: 09/286,297

[22] Filed: Apr. 6, 1999

[30] Foreign Application Priority Data

Apr. 7, 1998 [JP] Japan ..... 10-094410

[51] Int. Cl.[7] ..... G03G 9/107

[52] U.S. Cl. ..... 430/106.6; 430/108

[58] Field of Search ..... 430/106, 106.6, 430/108

[56] References Cited

U.S. PATENT DOCUMENTS

| | | | |
|---|---|---|---|
| 4,600,675 | 7/1986 | Iwasa et al. | 430/106.6 |
| 4,791,041 | 12/1988 | Aoki et al. | 430/108 |
| 4,847,176 | 7/1989 | Sano et al. | 430/106.6 |
| 5,110,703 | 5/1992 | Nagatsuka et al. | 430/108 |
| 5,256,511 | 10/1993 | Matsumura et al. | 430/108 |
| 5,670,287 | 9/1997 | Kawata et al. | 430/108 |

FOREIGN PATENT DOCUMENTS

| | | |
|---|---|---|
| 0 362 710 A2 | 4/1990 | European Pat. Off. . |
| 58-167606 | 10/1983 | Japan . |

*Primary Examiner*—John Goodrow

*Attorney, Agent, or Firm*—Burns, Doane, Swecker & Mathis, LLP

[57] ABSTRACT

The present invention relates to a binder carrier, comprising at least magnetic particles and a binder resin, characterized in that the binder resin comprises a thermoplastic silicone-modified acrylic resin and an amino-group-containing resin. The binder carrier is capable of preventing carrier degradation caused by toner ingredients such as a charge-control agent and a post-processing agent for the toner. The binder carrier of the present invention has a long life with less susceptibility to degradation in charging performance, and makes it possible to quickly charge the toner sufficiently.

20 Claims, No Drawings

BINDER CARRIER COMPRISING MAGNETIC PARTICLES AND SPECIFIC RESIN

This application is based on application No. Hei 10-094410 filed in Japan, the contents of which are hereby incorporated by reference.

BACKGROUND OF THE INVENTION

1. Field of the Invention

The present invention relates to a carrier used for a two-component developer in an image-forming apparatus such as a digital copying machine and a printer, and more particularly concerns a binder carrier with magnetic particles dispersed in a binder resin.

2. Description of the Prior Art

In copying machines or printers of the electrophotographic system, a two-component developing method has been put into practice in which a two-component developer containing toner and a magnetic carrier is used in developing an electrostatic latent image formed on an image-supporting member such as a photosensitive member.

With respect to carriers used for the two-component developer, various carriers, such as iron particle carrier, ferrite carrier, resin-coated carrier in which these magnetic particles are coated with resin, and binder carrier in which magnetic fine particles are dispersed in a resin, have been known. However, when the resin-coated carrier is carried onto the developing roller as magnetic brushes, its brush is very hard, failing to provide smooth images and causing disturbances in toner images and scratches to the photosensitive member due to scraping. Another problem with the resin-coated carrier is that the developer has a short life because separation of coated layers occurs as it is used.

The binder carrier has been noted as a carrier which can solve the above problem and which easily achieves a small particle size and has a high volume electric resistivity so that it is less susceptible to charge injection from the developer-supporting member.

However, in the conventional binder carrier, a charge-control agent and a post-processing agent tend to adhere to the carrier surface as it is used, causing degradation in the carrier charging-performance and failing to sufficiently charge the toner; this results in image noise such as fog in an image formed on a sheet.

Another problem with the conventional binder carrier is that because of its low electrification-build-up properties, when a toner supply is made after a copying process consuming a large amount of toner, such as a solid black image, toner charging can not be made quickly in a sufficient manner, with the result that fog occurs.

SUMMARY OF THE INVENTION

The present invention is to prevent degradation of carrier caused by toner components such as a charge-control agent and a post-treating agent and also to provide a binder carrier which is less susceptible to degradation in charging properties and has a long life.

Another objective of the present invention is to provide a carrier which can electrically charge toner quickly and sufficiently.

The present invention provides a binder carrier comprising:

magnetic particles; and a binder resin comprising a thermoplastic silicone-modified acrylic resin and an amino-group-containing resin.

DETAILED DESCRIPTION OF THE INVENTION

The present invention relates to a binder carrier comprising at least magnetic particles and a binder resin, which is characterized in that the binder resin comprises a thermoplastic silicone-modified acrylic resin and an amino-group-containing resin.

According to the present invention, when the binder resin contained in the binder resin comprises the thermoplastic silicone-modified acrylic resin and the amino-group-containing resin, durability and electrification-build-up properties can be achieved effectively.

The silicone-modified acrylic resin which is contained in the binder resin of the carrier of the present invention is the one obtained by co-polymerizing a polydiorganosiloxane macromer having an acrylic functional group and a radical polymerizable organic monomer.

The polydiorganosiloxane macromer having an acrylic functional group is represented by the following formula (1):

(1)

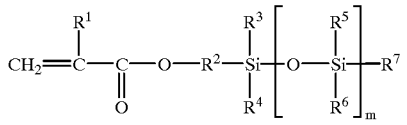

In the above formula (1), $R^1$ represents a hydrogen atom or an alkyl group. The alkyl group is exemplified by a lower alkyl group of C1 to C4, preferably C1 to C2, and more preferably a methyl group.

$R^2$ represents an alkylene group. The alkylene group is exemplified by a lower alkylene group of C1 to C5, preferably C2 to C4, and more preferably a propylene group.

$R^3$ to $R^6$ represent monovalent hydrocarbon groups and these may be the same or different. The monovalent hydrocarbon group is exemplified by a lower alkyl group of C1 to C4, preferably C1 to C2, an aryl group such as a phenyl group; an haloalkyl group such as a 3,3,3-trifluoropropyl group; and an alkenyl group such as a vinyl group and an allyl group. Particularly, $R^3$ to $R^6$ are the same and a methyl group.

$R^7$ is a group selected from the group consisting of a monovalent hydrocarbon group, a hydroxyl group and an acrylic functional group represented by the following formula (2):

(2)

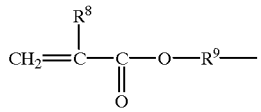

The monovalent hydrocarbon group is exemplified by a lower alkyl group of C1 to C4, and preferably C1 to C2. In particular, a methyl group is preferable. In the above formula (2), $R^8$ represents a hydrogen atom or an alkyl group. The alkyl group is exemplified by a lower alkyl group of C1 to C4, and preferably C1 to C2. In particular, a methyl group is preferable. R9 represents an alkylene group. The alkylene group is exemplified by a lower alkylene group of C1 to C5, preferably C2 to C4. In particular, a propylene group is preferable.

In the formula (1) "m" is an integer from 1 to 500, preferably 25 to 300, and more preferably 50 to 200.

When $R^7$ is a monovalent hydrocarbon group or a hydroxyl group in the formula (1), the above polydiorganosiloxane macromer having an acrylic functional group is prepared by using a lithium salt of organosilane represented by formula (3) as a polymerization initiator, polymerizing cyclic trisiloxane represented by formula (4) in non-equilibrium state, and terminating the polymerization reaction with an acid or triorganochlorosilane represented by formula (5) (see Japanese Patent Application Laid-Open No. Hei 2-92933).

(3)

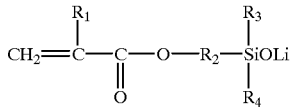

(4)

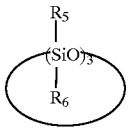

(5)

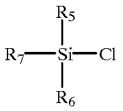

When $R^7$ is represented by the aforementioned formula (2), 1 mole of organopolysiloxane represented by formula (6) is subjected to condensation reaction with 1 mole of organochlorosilane represented by formula (7) and 1 mole of organochlorosilane represented by formula (8) (see Japanese Patent Application Laid-Open No. sho 58-167606).

(6)

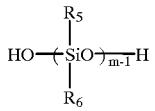

(7)

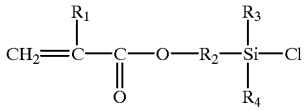

(8)

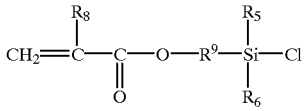

The radical polymerizable organic monomer, which is copolymerized with the above polydiorganosiloxane macromer having an acrylic functional group, is an acrylic organic monomer represented by the following formula (9):

(9)

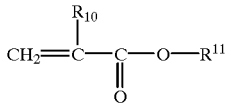

$R^{10}$ represents a hydrogen atom or an alkyl group. The alkyl group is exemplified by a lower alkyl group of C1 to C4, preferably C1 to C2. In particular, a methyl group is preferable. $R^{11}$ represents a monovalent hydrocarbon group. The monovalent hydrocarbon group is exemplified by a lower alkyl group of C1 to C4, preferably C1 to C2. In particular, a methyl group is preferable.

The silicone-modified acrylic resin used in the present invention is prepared by copolymerizing the above polydiorganosiloxane macromer (1) having an acrylic functional group and the radical polymerizable organic monomer (9) in the presence of a radical polymerization initiator such as azobisisobutyronitrile (AIBN).

The above copolymerization is preferably carried out in the presence of polyorganosiloxane represented by the following formula (10):

(10)

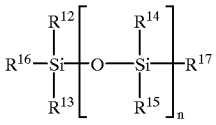

In the above formula, $R^{12}$ to $R^{15}$ may be the same or different, and represent a monovalent hydrocarbon group. The monovalent hydrocarbon group is exemplified by an alkenyl group such as a vinyl group and allyl group; an aryl group such as a phenyl group; an haloalkyl group such as 3,3,3-trifluoropropyl group, and a lower alkyl group of C1 to C4, preferably C1 to C2. In particular, $R^{12}$ to $R^{15}$ are preferably the same and a methyl group. $R^{16}$ and $R^{17}$ independently represent a monovalent hydrocarbon group or a hydroxyl group. The monovalent hydrocarbon group is exemplified by a lower alkyl group of C1 to C4, preferably C1 to C2. In particular, $R^{16}$ and $R^{17}$ are preferably the same and a methyl group.

In the formula (10), "n" is an integer from 1 to 500, preferably 25 to 300, more preferably 50 to 200.

Polyorganosiloxane represented by the formula (10) is a known compound, and may be prepared by an equilibrium-polymerization reaction of low molecular cyclic diorganopolysiloxane itself in the presence of an acid or alkali catalyst or by an equilibrium-polymerization reaction of low molecular cyclic diorganopolysiloxane and low molecular linear diorganopolysiloxane in the presence of an acid or an alkali catalyst, etc. For example, polydimethylsiloxane is commercially available as SH200 oil made by Toray Dow Corning Silicone K.K.

When polyorganosiloxane (10) is contained, an amount is set at 1/8 to 1, preferably 1/4 to 1/2 relative to a polydiorganopolysiloxane macromer (1). As an final product, the silicone-modified acrylic resin is prepared by co-polymerizing a polydiorganosiloxane macromer having an acrylic functional group represented by formula (1) and an acrylic organic monomer represented by formula (9) in the presence or in the absence of polydiorganosiloxane represented by formula (10), so that final silicone-modified acrylic resin has a ratio (Mac/Msi) of a repeating unit (Mac) represented by the following formula (11) and a repeating unit (Msi) represented by the following formula (12) in the range of 1/4 to 4/1. The ratio is preferably set in the range of 1/3 to 3/1, preferably 1/2 to 2/1.

(Mac)

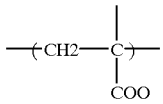

-continued (Msi)

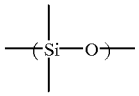

The ratio of Mac/Msi less than 1/4 may cause poor productivity. The ratio exceeding 4/1 may raise the possibility of an insufficient effect for preventing toner components such as a charge control agent and a post-processing agent from adhering the carrier surface.

Moreover, the silicone-modified acrylic resin finally obtained is adjusted so as to have a softening point of 120° C. to 250° C. as one of its properties.

In the present invention, a content of the silicone-modified acrylic resin is in the range of 3 to 90% by weight, preferably 10 to 80% by weight, more preferably 30 to 50% by weight. If the content is too small, problems such as toner fog and fog after copy of black solid image arise. Fog after copy of black solid image refers to a phenomenon in which, after toner has been rapidly supplied, fog appears due to a poor electrification-build-up properties. If the content is too large, it becomes difficult to carry out a kneading process in preparing carrier, and such a carrier prepared in the improper content is poor in its binding properties and fragile.

An amino-group-containing resin contained in the binder resin together with a silicone-modified acrylic resin is a co-polymer of an amino-group-containing monomer represented by the following formula (11) with a radical polymerizable monomer.

(11)

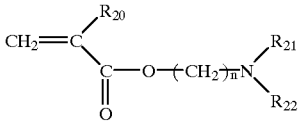

In the formula (11), $R^{20}$ represents a hydrogen atom, or a lower alkyl group such as a methyl group and an ethyl group. Preferable $R^{20}$ is methyl group. $R^{21}$ and $R^{22}$ independently represent a lower alkyl group such as a methyl group, an ethyl group and a propyl group. A methyl group is preferably for $R^{21}$ and $R^{22}$. In the formula (11), "n" is an integer from 1 to 5, preferably 2. Examples of the radical polymerizable monomer include a styrenic monomer such as styrene and a styrene derivative and an acrylic monomer such as alkyl acrylate and alkyl methacrylate. Examples of alkyl acrylate include butylacrylate, etc., and examples of alkyl methacrylate include butylmethacrylate, methylmethacrylate, etc. With respect to the radical polymerizable monomer, it is preferable to use a styrene monomer and an acrylic monomer in combination.

The amino-group-containing resin used in the present invention is prepared by co-polymerizing an amino-group-containing monomer represented by the above formula (11) and a radical polymerizable monomer in the presence of a radical polymerization initiator such as azobisisobutyronitrile (AIBN). In this case, the resulting amino-group-containing resin is properly adjusted in its copolymerization ratio and degree of polymerization so as to have the following properties: an amine value of 0.3 to 40 KOHmg/g, preferably 0.5 to 36 KOH/mg; a softening point (Tm) of 120° C. to 140° C., preferably 125° C. to 135° C., more preferably 130±3° C.; and a glass transition point (Tg) of 60 to 80° C., preferably 65° C. to 75° C., more preferably 70±3° C. If the amine value is too small, little contribution is made in improving the electrification-build-up properties and fogs appear more frequently after solid black images are copied. If the value is too high, there is no difference in contribution to the improvement of the electrification-build-up properties, and the quantity of charging amount becomes too high, resulting in a problem of a reduction in the image density after white-paper copying. The reduction in the image density after white-paper copying refers to a phenomenon in which, upon being sufficiently charged, the charging level of toner becomes so high that it becomes difficult for the toner to separate from the carrier, resulting in degradation in the developing properties.

A content of the amino-group-containing resin is in the range of 1 to 80% by weight, preferably 2 to 70% by weight. If the content is too small, little contribution is made in improving the electrification build-up properties, and fogs appears more frequently after black solid images are copied. If it is too high, there is no difference in contribution to the improvement of the electrification build-up properties; therefore, the addition exceeding a predetermined value does not effect to make the corresponding improvement, and the quantity of charge becomes too high, causing the problem of a reduction in the image density after white-paper copying.

With respect to the binder resin constituting the carrier of the present invention, a known resin usually used in toner, such as a polyester resin, a styrene-acrylic copolymer resin, a poly(metha)acrylic resin and epoxy resin, may be added in addition to the silicone-modified acrylic resin and the amino-group-containing resin. Among these, a poly(metha) acrylic resin is preferable since it may be used in both positively and negatively chargeable toner. In order to set the positive or negative charging quantity higher in a stable manner, it is preferable to use a polyester resin, an epoxy resin, etc. in the case where a positive-chargeable toner is used in combination with the carrier of the present invention, and it is preferable to use a styrene-acrylic copolymer resin, etc. in the case where a negative-chargeable toner is used in combination with the carrier of the present invention. An amount of addition of these polymers is up to 95% by weight of the binder resin, preferably 93% by weight, more preferably 70% by weight. If the amount is too high, the effect of addition of these silicone-modified resin and an amino-group-containing resin is reduced, and problems such as fog and scattering of toner may arise, although it depends on the combination of the silicone-modified resin and the amino-group-containing resin and their amounts and ratio.

The binder resin constituting the carrier of the present invention comprises a mixture of a silicone-modified resin, an amino-group-containing resin and another binder resin. The carrier of the present invention is prepared by, for example, the following methods: such binder resins and magnetic particles are heated and mixed in a predetermined mixing ratio (100 to 900 parts by weight, preferably 300 to 700 parts by weight with respect to 100 parts by weight of the binder resin), and after cooled, the resultant mixture is pulverized and classified; or such binder resins are dissolved in a solvent, and after magnetic particles are dispersed in the resin solution, the resultant solution spray-dried. The carrier thus obtained preferably has a volume-average particle size of 20 to 100 μm, preferably 30 to 80 μm.

The resultant carrier preferably has a saturated magnetization of 30 to 80 emu/g, preferably 35 to 65 emu/g, more preferably 40 to 60 emu/g. If the saturated magnetization of the carrier is too low, the magnetic restraint of the carrier, which is exerted on the developer transporting member, becomes smaller, making the image-supporting member more susceptible to carrier adhesion. If the saturated magnetization of the carrier becomes too high, the carrier tends to partially aggregate on the developer transporting member, failing to uniformly form a thin layer of the developer; this causes irregularity in the density of the resulting image and degradation in the reproducibility of half-tone images and high-definition images.

With respect to the magnetic fine particles contained in the carrier, for example, metals such as iron, nickel and cobalt, ferrite and magnetite may be used. In particular, magnetite is preferable. From the viewpoint of uniform dispersion in the binder resin, it is preferable that a particle size of these magnetic fine particles is not more than 5 $\mu$m, preferably not more than 2 $\mu$m, more preferably 0.1 to 1 $\mu$m in an average primary particle size.

The carrier of the present invention may contain a dispersing agent such as carbon black, silica, titania, and alumina. The addition of the dispersing agent makes it possible to uniformly disperse the magnetic particles in the binder resin. A content of the dispersing agent is preferably 0.01 to 3% by weight with respect to the carrier.

It is desirable that a content of toner in the present developer is in the range from 3 to 20% by weight, preferably from 5 to 10% by weight with respect to the carrier.

The content of toner less than 3% by weight fails to obtain a sufficient image density and causes an excessive charge of the toner. The content exceeding 20% by weight causes an insufficient charge of the toner, resulting in fog in copied images.

EXAMPLES

Resins constituting the binder resin used in preparing the carrier are listed as follows:

Polyester resin (Tm: 120° C., Tg: 65° C. (made by Kao K.K.))

Styrene-acryl copolymer resin (Tm :117° C., Tg: 67° C. (made by Mitsui Kagaku K.K.))

Silicone-modified acrylic resin: (softening point 200° C.; made by DCTS K.K). This silicone-modified acrylic resin comprises specific components as shown below;

① in formula (1), $R^1 = CH_3$, $R^2 = C_3H_6$, $R^3$–$R^7 = CH_3$,

② in formula (1), $R^1 = CH_3$, $R^2 = C_3H_6$, $R^3$–$R^5 = CH_3$, $$R^7 = C_3H_6OCOC(CH_3)=CH_2$$

③ in formula (10), $R^{12}$~$R^{17} = CH_3$, where Mac/Msi in the resin is 1/1.

Amino-group-containing styrene-acrylic resin shown in the following Table 1:

TABLE 1

| Amino-group-containing styrene-acrylic resin | Amine value (KOHmg/g) | Tg (° C.) | Tm (° C.) | Ratio of amino-group-containing monomer component to all monomer components |
|---|---|---|---|---|
| ① | 7 | 67 | 131 | 2% |
| ② | 15 | 71 | 130 | 4% |
| ③ | 4 | 72 | 129 | 1% |
| ④ | 0.5 | 69 | 132 | 0.2% |
| ⑤ | 36 | 73 | 133 | 10% |

In the above Table 1, resin ① is represented by formula (11) with $R_{20}$ to $R_{22}$ being respectively methyl groups and n being 2, resin ② with $R_{20}$ to $R_{22}$ being respectively methyl groups and n being 3, resin ③ with $R_{20}$ to $R_{22}$ being respectively methyl groups and n being 1, resin ④ with $R_{20}$ to $R_{22}$ being respectively methyl groups and n being 2, and resin ⑤ with $R_{20}$ to $R_{22}$ being respectively methyl groups and n being 3.

| Production example of carrier A | |
|---|---|
| Polyester resin | 50 parts by weight |
| Silicone-modified acrylic resin | 30 parts by weight |
| Amino-group-containing styrene-acrylic resin① | 20 parts by weight |
| Magnetite magnetic particles (RB-BL: Titan Kogyo K.K.) | 500 parts by weight |
| Carbon black (REGAL330: Cabot K.K.) | 2 parts by weight |

The above materials were sufficiently mixed in Henschel Mixer, and then melt and kneaded by a bent twin-screw extruder (PCM-65 made by Ikegai Tekko. K.K.) at 200° C. This kneaded matter was coarsely pulverized with a feather mill and successively finely pulverized with a mechanical granulator (ACM-10 Model: made by Hosokawa Micron K.K.), and this was classified with an air classifier (MS-1 Model:made by Hosokawa Micron K.K.). The classified product was subjected to a heating treatment at 350° C. by Surfusing System (SFS-2 Model: made by Nippon Pneumatic MFG. K.K.), to give a carrier having an volume-average particle size of 60 $\mu$m. The resulting carrier is referred to as carrier A.

| Production example of carrier B | |
|---|---|
| Polyester resin | 30 parts by weight |
| Silicone-modified acrylic resin | 20 parts by weight |
| Amino-group-containing styrene-acrylic resin② | 50 parts by weight |
| Ferrite magnetic particles (MFP-2: made by TDK K.K.) | 500 parts by weight |
| Carbon black (REGAL330: Cabot K.K..) | 2 parts by weight |

By using the above materials, the same preparation method as carrier A was carried out, to give a carrier having a volume-average particle size of 55 $\mu$m. The resulting carrier is referred to as carrier B.

| Production example of carrier C | |
|---|---|
| Silicone-modified acrylic resin | 60 parts by weight |
| Amino-group-containing styrene-acrylic resin⑤ | 40 parts by weight |
| Magnetite magnetic particles (RB-BL: Titan Kogyo K.K.) | 550 parts by weight |
| Carbon black (#970: Mitsubishi Kagaku K.K.) | 2 parts by weight |

By using the above materials, the same preparation method as carrier A was carried out, to give a carrier having a volume-average particle size of 55 $\mu$m. The resulting carrier is referred to as carrier C.

| Production example of carrier D | |
|---|---|
| Styrene-acryl copolymer | 20 parts by weight |
| Silicone-modified acrylic resin | 10 parts by weight |
| Amino-group-containing styrene-acrylic resin② | 70 parts by weight |
| Magnetite magnetic particles (RB-BL: Titan Kogyo K.K.) | 500 parts by weight |
| Carbon black (REGAL330: Cabot K.K..) | 3 parts by weight |

By using the above materials, the same preparation method as carrier A was carried out, to give a carrier having a volume-average particle size of 55 $\mu$m. The resulting carrier is referred to as carrier D.

| Production example of carrier E | |
|---|---|
| Polyester resin | 25 parts by weight |
| Silicone-modified acrylic resin | 70 parts by weight |
| Amino-group-containing styrene-acrylic resin③ | 5 parts by weight |
| Ferrite magnetic particles (MFP-2: made by TDK K.K.) | 500 parts by weight |
| Carbon black (#970: made by Mitsubishi Kagaku K.K.) | 3 parts by weight |

By using the above materials, the same preparation method as carrier A was carried out, to give a carrier having a volume-average particle size of 55 μm. The resulting carrier is referred to as carrier E.

| Production example of carrier F | |
|---|---|
| Styrene-acryl copolymer | 50 parts by weight |
| Silicone-modified acrylic resin | 30 parts by weight |
| Amino-group-containing styrene-acrylic resin ④ | 20 parts by weight |
| Magnetite magnetic particles (EPT-1000: made by Toda Kogyo K.K.) | 500 parts by weight |
| Carbon black (#970: made by Mitsubishi Kagaku K.K.) | 2 parts by weight |

By using the above materials, the same preparation method as carrier A was carried out, to give a carrier having a volume-average particle size of 60 μm. The resulting carrier is referred to as carrier F.

| Production example of carrier G | |
|---|---|
| Styrene-acryl copolymer | 68 parts by weight |
| Silicone-modified acrylic resin | 30 parts by weight |
| Amino-group-containing styrene-acrylic resin ① | 2 parts by weight |
| Ferrite magnetic particles (MFP-2: made by TDK K.K.) | 500 parts by weight |
| Carbon black (Ketchen: made by Lion Yushi K.K.) | 2 parts by weight |

By using the above materials, the same preparation method as carrier A was carried out, to give a carrier having a volume-average particle size of 60 μm. The resulting carrier is referred to as carrier G.

| Production example of carrier H | |
|---|---|
| Silicone-modified acrylic resin | 75 parts by weight |
| Amino-group containing styrene-acrylic resin ⑤ | 25 parts by weight |
| Magnetite magnetic particles (EPT-1000: Toda Kogyo K.K.) | 500 parts by weight |
| Carbon black (Ketchen: made by Lion Yushi K.K.) | 2 parts by weight |

By using the above materials, the same preparation method as carrier A was carried out, to give a carrier having a volume-average particle size of 55 μm. The resulting carrier is referred to as carrier H.

| Production example of carrier I | |
|---|---|
| Styrene-acryl copolymer | 15 parts by weight |
| Silicone-modified acrylic resin | 80 parts by weight |

-continued

| Production example of carrier I | |
|---|---|
| Amino-group-containing styrene-acrylic resin ③ | 5 parts by weight |
| Magnetite magnetic particles (RB-BL: made by Titan Kogyo K.K.) | 550 parts by weight |
| Carbon black (REGAL330: made by Cabot K.K..) | 2 parts by weight |

By using the above materials, the same preparation method as carrier A was carried out, to give a carrier having a volume-average particle size of 60 μm. The resulting carrier is referred to as carrier I.

| Production example of carrier J | |
|---|---|
| Polyester resin | 45 parts by weight |
| Silicone-modified acrylic resin | 5 parts by weight |
| Amino-group-containing styrene-acrylic resin② | 50 parts by weight |
| Ferrite magnetic particles (MFP-2: made by TDK K.K.) | 500 parts by weight |
| Carbon black (#970: made by Mitsubishi Kagaku K.K.) | 3 parts by weight |

By using the above materials, the same preparation method as carrier A was carried out, to give a carrier having a volume-average particle size of 60 μm. The resulting carrier is referred to as carrier J.

| Production example of carrier K | |
|---|---|
| Styrene-acryl copolymer | 93 parts by weight |
| Silicone-modified acrylic resin | 5 parts by weight |
| Amino-group-containing styrene-acrylic resin ① | 2 parts by weight |
| Magnetite magnetic particles (RB-BL: made by Titan Kogyo K.K.) | 500 parts by weight |
| Carbon black (REGAL330: made by Cabot K.K..) | 2 parts by weight |

By using the above materials, the same preparation method as carrier A was carried out, to give a carrier having a volume-average particle size of 60 μm. The resulting carrier is referred to as carrier K.

| Production example of carrier L | |
|---|---|
| Styrene-acryl copolymer | 70 parts by weight |
| Silicone-modified acrylic resin | 30 parts by weight |
| Magnetite magnetic particles (EPT-1000: made by Toda Kogyo K.K.) | 500 parts by weight |
| Carbon black (#970: made by Mitsubishi Kagaku K.K.) | 3 parts by weight |

By using the above materials, the same preparation method as carrier A was carried out, to give a carrier having a volume-average particle size of 55 μm. The resulting carrier is referred to as carrier L.

| Production example of carrier M | |
|---|---|
| Polyester resin | 80 parts by weight |
| Amino-group-containing styrene-acrylic resin ④ | 20 parts by weight |

-continued

| Production example of carrier M | |
|---|---|
| Ferrite magnetic particles (MFP-2: made by TDK K.K.) | 500 parts by weight |
| Carbon black (REGAL330: made by Cabot K.K.) | 2 parts by weight |

By using the above materials, the same preparation method as carrier A was carried out, to give a carrier having a volume-average particle size of 55 μm. The resulting carrier is referred to as carrier M.

| Production example of carrier N | |
|---|---|
| Polyester resin | 10 parts by weight |
| Amino-group containing styrene-acrylic resin (5) | 90 parts by weight |
| Magnetite magnetic particles (RB-BL: made by Titan Kogyo K.K.) | 500 parts by weight |
| Carbon black (#970: made by Mitsubishi Kagaku K.K.) | 2 parts by weight |

By using the above materials, the same preparation method as carrier A was carried out, to give a carrier having a volume-average particle size of 60 μm. The resulting carrier is referred to as carrier N.

| Production example of carrier O | |
|---|---|
| Styrene-acryl copolymer | 100 parts by weight |
| Magnetite magnetic particles (EPT-1000: made by Toda Kogyo K.K.) | 500 parts by weight |
| Carbon black (Ketchen: made by Lion Yushi K.K.) | 2 parts by weight |

By using the above materials, the same preparation method as carrier A was carried out, to give a carrier having a volume-average particle size of 60 μm. The resulting carrier is referred to as carrier O.

| Production of carrier P | |
|---|---|
| Silicone-modified acrylic resin | 95 parts by weight |
| Amino-group-containing styrene-acrylic resin (5) | 2 parts by weight |
| Magnetite magnetic particles (RB-BL: made by Titan Kogyo K.K.) | 500 parts by weight |
| Carbon black (REGAL330: made by Cabot K.K..) | 2 parts by weight |

By using the above materials, the same preparation method as carrier A was carried out; however, no carrier practically usable was obtained.

| Production of toner a | |
|---|---|
| Thermoplastic polyester resin (softening point 120° C., glass transition point 61° C.) | 100 parts by weight |
| Carbon black (Mogul L: made by Cabot K.K.) | 8 parts by weight |
| Low molecular weight propylene (Viscol 550P: made by Sanyo Kasei Kogyo K.K.) | 3 parts by weight |
| Negative charge-control agent (Bontron S-34: made by Orient Kagaku K.K.) | 5 parts by weight |

The above materials were sufficiently mixed, and then melt and kneaded by using a bent twin-screw extruder at 140° C. After cooled, this kneaded materials were coarsely pulverized with a feather mill and successively finely pulverized with a jet mill, and classified with an air classifier. Thus, black fine particles having a volume-average particle size of 9 μm were obtained. To 100 parts by weight of this black fine particles was added 0.3 part by weight of hydrophobic silica (H-2000: made by Hoechst Japan K.K.), and this was processed by Henschel Mixer (Mitsui Miike Kakouki K.K.) at 1,000 rpm for one minute, to give a negatively chargeable toner. The resulting toner is referred to as toner a.

Production of Toner b

Polyester resin (softening point 100° C., glass transition point 58° C.) and magenta pigment (C.I. Pigment Red 184) were put into a pressure kneader so as to be set at a weight ratio of 7:3 (resin:pigment), and kneaded. After cooled, the resulting kneaded matter was pulverized by a feather mill, to give a pigment master batch.

The above polyester resin (93 parts by weight), 10 parts by weight of the master batch and 2 parts by weight of a zinc salicylate complex (E-84: Orient Kagaku K.K.) were subjected to the same processes as the production example of toner a, to give fine particles having a volume-average particle size of 8.5 μm. To 100 parts by weight of this black fine particles were added 0.5 part by weight of hydrophobic silica (H-2000: made by Hoechst Japan K.K.) and 0.6 part by weight of titanium oxide fine particles (STT-30A: made by Titan Kogyo K.K.). This mixture was processed by Henschel Mixer at 1,000 rpm for 1 minute, to give a magenta toner. The resulting toner is referred to as toner b.

EXAMPLES 1 THROUGH 11 AND COMPARATIVE EXAMPLE 1 THROUGH 4

By using the above carriers A through O and toner a, developers, which were to be used in Examples and Comparative Examples, were produced at a ratio (T/C) of toner (T) to carrier (C), of 6% by weight in the combinations as shown in the following Table 2.

TABLE 2

| | Carrier | Toner | Toner mixing ratio |
|---|---|---|---|
| Example 1 | A | a | 6% |
| Example 2 | B | a | 6% |
| Example 3 | C | a | 6% |
| Example 4 | D | a | 6% |
| Example 5 | E | a | 6% |
| Example 6 | F | a | 6% |
| Example 7 | G | a | 6% |
| Example 8 | H | a | 6% |
| Example 9 | I | a | 6% |
| Example 10 | J | a | 6% |
| Example 11 | K | a | 6% |
| Example 12 | A | b | 6% |
| Example 13 | B | b | 6% |
| Example 14 | C | b | 6% |
| Example 15 | D | b | 6% |
| Example 16 | E | b | 6% |
| Example 17 | F | b | 6% |
| Example 18 | G | b | 6% |
| Example 19 | H | b | 6% |
| Example 20 | I | b | 6% |
| Example 21 | J | b | 6% |
| Example 22 | K | b | 6% |
| Comparative Example 1 | L | a | 6% |
| Comparative Example 2 | M | a | 6% |
| Comparative Example 3 | N | a | 6% |
| Comparative Example 4 | O | a | 6% |
| Comparative Example 5 | L | b | 6% |
| Comparative Example 6 | M | b | 6% |
| Comparative Example 7 | N | b | 6% |
| Comparative Example 8 | O | b | 6% |

Evaluation 1 (Evaluation of fog)

Each of the developers obtained by examples 1 through 11 and comparative examples 1 through 4 were mixed by a roll mill for one hour. This developer was put into a copying machine Di-30 made by Minolta K.K., and was subjected to endurance copying processes of 300,000 sheets to duplicate an image having a B/W ratio of 15% under N/N environment (25° C., 50%), H/H environment (30° C., 80%) and L/L environment (10° C., 10%) respectively. Then, copied images on white paper were visually observed with respect to fogs at the initial stage, 10,000-sheet stage (10K), 50,000-sheet stage (50K), 100,000-sheet stage (150K), 150,000-sheet stage (150K), 200,000-sheet stage (200K), 250,000-sheet stage (250K) and 300,000-sheet stage (300K).

The evaluation was made to be ranked as follows:

⊙: Rank 5: No fog;

○: Rank 3 to 4: Not visually observed, but fogs were observed by means of a microscope, etc;

Δ: Rank 2: Fog were visually observed slightly; and x: Rank 1: Fogs were observed all over.

Results are shown in the following Table 3:

Evaluation 2 (Evaluation of Fog)

Each of the developers obtained by examples 12 through 22 and comparative examples 5 through 8 were mixed by a roll mill for one hour. This developer was put into copying machine CF-70 made by Minolta K.K., and was subjected to endurance copying processes of 150,000 sheets to duplicate an image having a B/W ratio of 15% under N/N environment (25° C., 50%), H/H environment (30° C., 80%) and L/L environment (10° C., 10%) respectively. Then, copied images on white paper were visually observed with respect to fogs at the initial stage, 10,000-sheet stage (10K), 50,000-sheet stage (50K). 100,000-sheet stage (100K) and 150,000-sheet stage (150K). The evaluation was made and ranked in manner similar to Evaluation 1. Results are shown in the following Table 4:

TABLE 3

Fog Evaluation (Di-30 Copying Machine) (in order of N/N, H/H, L/L)

| | Carrier | Initial | | | 10K | | | 50K | | | 100K | | | 150K | | | 200K | | | 250K | | | 300K | | |
|---|---|---|---|---|---|---|---|---|---|---|---|---|---|---|---|---|---|---|---|---|---|---|---|---|---|
| Example 1 | A | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ |
| Example 2 | B | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ○ | ○ | ○ |
| Example 3 | C | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ |
| Example 4 | D | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ○ | ○ | ○ |
| Example 5 | E | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ |
| Example 6 | F | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ |
| Example 7 | G | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ |
| Example 8 | H | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ○ | ○ | ○ | ○ | ○ | ○ |
| Example 9 | I | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ○ | ○ | ○ | ○ | ○ | ○ | ○ | ○ | ○ |
| Example 10 | J | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ○ | ○ | ○ | ○ | ○ | ○ | ○ | x | ○ |
| Example 11 | K | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ | ○ | ○ | ○ | ○ | ○ | ○ | ○ | x | ○ |
| Comparative Example 1 | L | ⊙ | ⊙ | ⊙ | ⊙ | ⊙ | ⊙ | ⊙ | ⊙ | ⊙ | ○ | ○ | ○ | x | x | x | x | x | x | x | x | x | x | x | x |
| Comparative Example 2 | M | ⊙ | ⊙ | ⊙ | ⊙ | ⊙ | ⊙ | ○ | ○ | ○ | x | x | x | x | x | x | x | x | x | x | x | x | x | x | x |
| Comparative Example 3 | N | ⊙ | ⊙ | ⊙ | ⊙ | ⊙ | ⊙ | ○ | ○ | ○ | x | x | x | x | x | x | x | x | x | x | x | x | x | x | x |
| Comparative Example 4 | O | ⊙ | ⊙ | ⊙ | ○ | ○ | ○ | x | x | x | x | x | x | x | x | x | x | x | x | x | x | x | x | x | x |

TABLE 4

Fog Evaluation (CF-70 Copying Machine) (in order of N/N, H/H, L/L)

| | Carrier | Initial | | | 10 K | | | 50 K | | | 100 K | | | 150 K | | |
|---|---|---|---|---|---|---|---|---|---|---|---|---|---|---|---|---|
| Example 12 | A | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ |
| Example 13 | B | ⊙ | ⊙ | ⊙ | ⊙ | ⊙ | ⊙ | ⊙ | ⊙ | ⊙ | ⊙ | ⊙ | ⊙ | ○ | ○ | ○ |
| Example 14 | C | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ |
| Example 15 | D | ⊙ | ⊙ | ⊙ | ⊙ | ⊙ | ⊙ | ⊙ | ⊙ | ⊙ | ⊙ | ⊙ | ⊙ | ○ | ○ | ○ |
| Example 16 | E | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ |
| Example 17 | F | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ |
| Example 18 | G | ⊙ | ⊙ | ⊙ | ⊙ | ⊙ | ⊙ | ⊙ | ⊙ | ⊙ | ⊙ | ⊙ | ⊙ | ⊙ | ⊙ | ⊙ |
| Example 19 | H | ⊙ | ⊙ | ⊙ | ⊙ | ⊙ | ⊙ | ⊙ | ⊙ | ⊙ | ⊙ | ○ | ⊙ | ○ | ○ | ○ |
| Example 20 | I | ⊙ | ⊙ | ⊙ | ⊙ | ⊙ | ⊙ | ⊙ | ⊙ | ⊙ | ○ | ○ | ○ | ○ | ○ | ○ |
| Example 21 | J | ⊙ | ⊙ | ⊙ | ⊙ | ⊙ | ⊙ | ⊙ | ⊙ | ⊙ | ○ | ○ | ○ | ○ | x | ○ |
| Example 22 | K | ⊙ | ⊙ | ⊙ | ⊙ | ⊙ | ⊙ | ⊙ | ⊙ | ⊙ | ○ | ○ | ○ | ○ | x | ○ |
| Comparative Example 5 | L | ⊙ | ⊙ | ⊙ | ⊙ | ⊙ | ⊙ | ⊙ | ○ | ⊙ | x | x | x | x | x | x |
| Comparative Example 6 | M | ⊙ | ⊙ | ⊙ | ⊙ | ⊙ | ⊙ | ○ | ○ | ○ | x | x | x | x | x | x |
| Comparative Example 7 | N | ⊙ | ⊙ | ⊙ | ⊙ | ⊙ | ⊙ | ○ | ○ | ○ | x | x | x | x | x | x |
| Comparative Example 8 | O | ⊙ | ⊙ | ⊙ | ○ | ○ | ○ | x | x | x | x | x | x | x | x | x |

Evaluation 3 (Evaluation of carrier consumption)

Each of the developers obtained by examples 1 through 11 and comparative examples 1 through 4 were mixed by a roll mill for one hour. This developer was put into a copying machine Di-30 made by Minolta K.K., and was subjected to endurance copying processes of 300,000 sheets to duplicate an image having a B/W ratio of 15% under N/N environment (25° C., 50%), H/H environment (30° C., 80%) and L/L environment (10° C., 10%) respectively. Then, evaluation was made on the amount of carrier consumption with respect to each of the initial stage, 10,000-sheet stage (10K), 50,000-sheet stage (50K), 100,000-sheet stage (100K), 150,000-sheet stage (150K), 200,000-sheet stage (200K), 250,000-sheet stage (250K) and 300,000-sheet stage (300K).

After cleaning, toner was collected in each stage, and the collected toner was burnt, and then the carrier content was calculated. The evaluation was ranked as follows:

◎: The carrier content was less than 80 mg/K;

○: The carrier content was in the range of not less than 80 to less than 120 mg/K;

x: The carrier content was not less than 120 mg/K.

Results are shown in the following Table 5:

Evaluation 4 (Evaluation of carrier consumption)

Each of the developers obtained by examples 12 through 22 and comparative examples 5 through 8 were mixed by a roll mill for one hour. This developer was put into a copying machine CF-70 made by Minolta K.K., and was subjected to endurance copying processes of 150,000 sheets to duplicate an image having a B/W ratio of 15 % under N/N environment (25° C., 50%), H/H environment (30° C., 80%) and L/L environment (10° C., 10%) respectively. Then, evaluation was made on the amount of carrier consumption with respect to each of the initial stage, 10,000-sheet stage (10K), 50,000-sheet stage (50K), 100,000-sheet stage (100K) and 150,000-sheet stage (150K). The evaluation was made in the same manner as Evaluation 3. Results are shown in the following Table 6:

TABLE 5

Carrier Amount of Consumption (Di-30 Copying Machine) (in order of N/N, H/H, L/L)

| | Carrier | Initial | | | 10 K | | | 50 K | | | 100 K | | | 150 K | | | 200 K | | | 250 K | | | 300 K | | |
|---|---|---|---|---|---|---|---|---|---|---|---|---|---|---|---|---|---|---|---|---|---|---|---|---|---|
| Example 1 | A | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ |
| Example 2 | B | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ |
| Example 3 | C | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ○ | ○ | ○ |
| Example 4 | D | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ |
| Example 5 | E | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ○ | ○ | ○ |
| Example 6 | F | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ |
| Example 7 | G | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ |
| Example 8 | H | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ○ | ○ | ○ | ○ | ○ | x |
| Example 9 | I | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ○ | ○ | ○ | ○ | ○ | x |
| Example 10 | J | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ○ | ○ | ○ |
| Example 11 | K | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ○ | ○ | ○ |
| Comparative Example 1 | L | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ○ | ○ |
| Comparative Example 2 | M | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ○ | ○ | ○ |
| Comparative Example 3 | N | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ○ | ○ | x |
| Comparative Example 4 | O | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ○ | ○ | ○ |

TABLE 6

Carrier Amount of Consumption (CF-70 Copying Machine) (in order of N/N, H/H, L/L)

| | Carrier | Initial | | | 10 K | | | 50 K | | | 100 K | | | 150 K | | |
|---|---|---|---|---|---|---|---|---|---|---|---|---|---|---|---|---|
| Example 12 | A | ◎ | ◎ | ◎ | ◎ | ◎ | ◎ | ◎ | ◎ | ◎ | ◎ | ◎ | ◎ | ◎ | ◎ | ◎ |
| Example 13 | B | ◎ | ◎ | ◎ | ◎ | ◎ | ◎ | ◎ | ◎ | ◎ | ◎ | ◎ | ◎ | ◎ | ◎ | ◎ |
| Example 14 | C | ◎ | ◎ | ◎ | ◎ | ◎ | ◎ | ◎ | ◎ | ◎ | ◎ | ◎ | ◎ | ○ | ○ | ○ |
| Example 15 | D | ◎ | ◎ | ◎ | ◎ | ◎ | ◎ | ◎ | ◎ | ◎ | ◎ | ◎ | ◎ | ◎ | ◎ | ◎ |
| Example 16 | E | ◎ | ◎ | ◎ | ◎ | ◎ | ◎ | ◎ | ◎ | ◎ | ◎ | ◎ | ◎ | ○ | ○ | ○ |
| Example 17 | F | ◎ | ◎ | ◎ | ◎ | ◎ | ◎ | ◎ | ◎ | ◎ | ◎ | ◎ | ◎ | ◎ | ◎ | ◎ |
| Example 18 | G | ◎ | ◎ | ◎ | ◎ | ◎ | ◎ | ◎ | ◎ | ◎ | ◎ | ◎ | ◎ | ◎ | ◎ | ◎ |
| Example 19 | H | ◎ | ◎ | ◎ | ◎ | ◎ | ◎ | ◎ | ◎ | ◎ | ○ | ○ | ○ | ○ | ○ | x |
| Example 20 | I | ◎ | ◎ | ◎ | ◎ | ◎ | ◎ | ◎ | ◎ | ◎ | ○ | ○ | ○ | ○ | ○ | x |
| Example 21 | J | ◎ | ◎ | ◎ | ◎ | ◎ | ◎ | ◎ | ◎ | ◎ | ◎ | ◎ | ◎ | ○ | ○ | ○ |
| Example 22 | K | ◎ | ◎ | ◎ | ◎ | ◎ | ◎ | ◎ | ◎ | ◎ | ◎ | ◎ | ◎ | ○ | ○ | ○ |
| Comparative Example 5 | L | ◎ | ◎ | ◎ | ◎ | ◎ | ◎ | ◎ | ◎ | ◎ | ◎ | ◎ | ◎ | ◎ | ○ | ○ |
| Comparative Example 6 | M | ◎ | ◎ | ◎ | ◎ | ◎ | ◎ | ◎ | ◎ | ◎ | ◎ | ◎ | ◎ | ○ | ○ | ○ |
| Comparative Example 7 | N | ◎ | ◎ | ◎ | ◎ | ◎ | ◎ | ◎ | ◎ | ◎ | ◎ | ◎ | ◎ | ○ | ○ | x |
| Comparative Example 8 | O | ◎ | ◎ | ◎ | ◎ | ◎ | ◎ | ◎ | ◎ | ◎ | ◎ | ◎ | ◎ | ○ | ○ | ○ |

Evaluation 5 (Evaluation of fogs after copy of solid image document)

Each of the developers obtained by examples 1 through 11 and comparative examples 1 through 4 were mixed by a roll mill for one hour. This developer was put into a copying machine Di-30 made by Minolta K.K., and was subjected to endurance copying processes of 300,000 sheets to duplicate an image having a B/W ratio of 15% under N/N environment (25° C., 50%), H/H environment (30° C., 80%) and L/L environment (10° C., 10%) respectively. Then, copied image was obtained by using white document after making a copy using solid image document at each of the initial stage, 10,000-sheet stage (10K), 50,000-sheet stage (50K), 100,000-sheet stage (100K), 150,000-sheet stage (150K), 200,000-sheet stage (200K), 250,000-sheet stage (250K) and 300,000-sheet stage (300K). The copied images were visually observed for fogs.

The evaluation was made to be ranked as follows.

⊚: Rank 5: No fog;

○: Rank 3 to 4: Not visually observed, but fogs were observed under a microscope, etc;

Δ: Rank 2: Fogs were visually observed slightly; and x: Rank 1: Fogs were observed all over.

Results are shown in the following Table 7:

Evaluation 6 (Evaluation of fogs after copy of solid black document)

Each of the developers obtained by examples 12 through 22 and comparative examples 5 through 8 were mixed by a roll mill for one hour. This developer was put into a copying machine CF-70 made by Minolta K.K., and was subjected to endurance copying processes of 150,000 sheets to duplicate an image having a B/W ratio of 15% under N/N environment (25° C., 50%), H/H environment (30° C., 80%) and L/L environment (10° C., 10%) respectively. Then, copied image was obtained by using white document after making a copy using solid image document at each of the initial stage, 10,000-sheet stage (10K), 50,000-sheet stage (50K), 100,000-sheet stage (100K) and 150,000-sheet stage (150K). The copied images were visually observed for fogs. The evaluation was made and ranked in a manner similar to Evaluation 5. Results are shown in the following Table 8:

TABLE 7

Fogs after copy of solid image document (Di-30 Copying Machine) (in order of N/N, H/H, L/L)

| | Carrier | Initial | | | 10 K | | | 50 K | | | 100 K | | | 150 K | | | 200 K | | | 250 K | | | 300 K | | |
|---|---|---|---|---|---|---|---|---|---|---|---|---|---|---|---|---|---|---|---|---|---|---|---|---|---|
| Example 1 | A | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ |
| Example 2 | B | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ○ | ○ | ○ |
| Example 3 | C | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ |
| Example 4 | D | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ○ | ○ | ○ |
| Example 5 | E | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ○ | ○ | ○ |
| Example 6 | F | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ○ | ⊚ | ○ | ○ | ○ | ○ | x | ○ |
| Example 7 | G | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ○ | ○ | ○ | ○ | ○ | ○ | ○ | x | ○ |
| Example 8 | H | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ○ | ○ | ○ | ○ | ○ | ○ |
| Example 9 | I | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ○ | ○ | ○ | ○ | ○ | ○ | ○ | ○ | ○ |
| Example 10 | J | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ○ | ○ | ○ | ○ | ○ | ○ | ○ | x | ○ |
| Example 11 | K | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ | ○ | ○ | ○ | ○ | ○ | ○ | ○ | x | ○ |
| Comparative Example 1 | L | ⊚ | ⊚ | ⊚ | ○ | ○ | ○ | ○ | x | ○ | x | x | x | x | x | x | x | x | x | x | x | x | x | x | x |
| Comparative Example 2 | M | ⊚ | ⊚ | ⊚ | ⊚ | ⊚ | ⊚ | ○ | ○ | ○ | x | x | x | x | x | x | x | x | x | x | x | x | x | x | x |
| Comparative Example 3 | N | ⊚ | ⊚ | ⊚ | ⊚ | ⊚ | ⊚ | ○ | ○ | ○ | x | x | x | x | x | x | x | x | x | x | x | x | x | x | x |
| Comparative Example 4 | O | ⊚ | ⊚ | ⊚ | ○ | ○ | ○ | x | x | x | x | x | x | x | x | x | x | x | x | x | x | x | x | x | x |

TABLE 8

Fog after copy of solid image document (CF-70 Copying Machine) (in order of N/N, H/H, L/L)

| | Carrier | Initial | | | 10 K | | | 50 K | | | 100 K | | | 150 K | | |
|---|---|---|---|---|---|---|---|---|---|---|---|---|---|---|---|---|
| Example 12 | A | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ |
| Example 13 | B | ⊚ | ⊚ | ⊚ | ⊚ | ⊚ | ⊚ | ⊚ | ⊚ | ⊚ | ⊚ | ⊚ | ⊚ | ○ | ○ | ○ |
| Example 14 | C | ⊚ | ⊚ | ⊚ | ⊚ | ⊚ | ⊚ | ⊚ | ⊚ | ⊚ | ⊚ | ⊚ | ⊚ | ⊚ | ⊚ | ⊚ |
| Example 15 | D | ⊚ | ⊚ | ⊚ | ⊚ | ⊚ | ⊚ | ⊚ | ⊚ | ⊚ | ⊚ | ⊚ | ⊚ | ○ | ○ | ○ |
| Example 16 | E | ⊚ | ⊚ | ⊚ | ⊚ | ⊚ | ⊚ | ⊚ | ⊚ | ⊚ | ⊚ | ⊚ | ⊚ | ○ | ○ | ○ |
| Example 17 | F | ⊚ | ⊚ | ⊚ | ⊚ | ⊚ | ⊚ | ⊚ | ⊚ | ⊚ | ○ | ○ | ○ | ○ | x | ○ |
| Example 18 | G | ⊚ | ⊚ | ⊚ | ⊚ | ⊚ | ⊚ | ⊚ | ⊚ | ⊚ | ○ | ○ | ○ | ○ | x | ○ |
| Example 19 | H | ⊚ | ⊚ | ⊚ | ⊚ | ⊚ | ⊚ | ⊚ | ⊚ | ⊚ | ⊚ | ○ | ⊚ | ○ | ○ | ○ |
| Example 20 | I | ⊚ | ⊚ | ⊚ | ⊚ | ⊚ | ⊚ | ⊚ | ⊚ | ⊚ | ○ | ○ | ○ | ○ | ○ | ○ |
| Example 21 | J | ⊚ | ⊚ | ⊚ | ⊚ | ⊚ | ⊚ | ⊚ | ⊚ | ⊚ | ○ | ○ | ○ | ○ | x | ○ |
| Example 22 | K | ⊚ | ⊚ | ⊚ | ⊚ | ⊚ | ⊚ | ⊚ | ⊚ | ⊚ | ○ | ○ | ○ | ○ | x | ○ |
| Comparative Example 5 | L | ⊚ | ⊚ | ⊚ | ○ | ○ | ○ | ○ | x | ○ | x | x | x | x | x | x |
| Comparative Example 6 | M | ⊚ | ⊚ | ⊚ | ⊚ | ⊚ | ⊚ | ○ | ○ | ○ | x | x | x | x | x | x |
| Comparative Example 7 | N | ⊚ | ⊚ | ⊚ | ⊚ | ⊚ | ⊚ | ○ | ○ | ○ | x | x | x | x | x | x |
| Comparative Example 8 | O | ⊚ | ⊚ | ⊚ | ○ | ○ | ○ | x | x | x | x | x | x | x | x | x |

Evaluation 7 (Image density after copy of white document)

Each of the developers obtained by examples 1 through 11 and comparative examples 1 through 4 were mixed by a roll mill for one hour. This developer was put into a copying machine Di-30 made by Minolta K.K., and was subjected to endurance copying processes of 300,000 sheets to duplicate an image having a B/W ratio of 15% under N/N environment (25° C., 50%), H/H environment (30° C., 80%) and L/L environment (10° C., 10%) respectively. Then, copied image was obtained by using solid image document after making a copy using white document at each of the initial stage, 10,000-sheet stage (10K), 50,000-sheet stage (50K), 100,000-sheet stage (100K), 150,000-sheet stage (150K), 200,000-sheet stage (200K), 250,000-sheet stage (250K) and 300,000-sheet stage (300K). The image density of the solid image was measured by a reflection densitometer (made by Macbeth K.K.).

The evaluation was made to be ranked as follows:

◎: Image density; not less than 1.4

○: Image density; in the range of not less than 1.3 to less than 1.4

Δ: Image density; in the range of not less than 1.2 to less than 1.3 x: Image density; less than 1.2.

Results are shown in the following Table 9:

Evaluation 8 (Image density after copy of white document)

Each of the developers obtained by examples 12 through 22 and comparative examples 5 through 8 were mixed by a roll mill for one hour. This developer was put into a copying machine CF-70 made by Minolta K.K., and was subjected to endurance copying processes of 150,000 sheets to duplicate an image having a B/W ratio of 15% under N/N environment (25° C., 50%), H/H environment (30° C., 80%) and L/L environment (10° C., 10%) respectively. Then, copied image was obtained by using solid image document after making a copy using white document at each of the initial stage, 10,000-sheet stage (10K), 50,000-sheet stage (50K), 100,000-sheet stage (100K) and 150,000-sheet stage (150K). The image density of the solid image was measured by a reflection densitometer (made by Macbeth K.K.). The evaluation was made and ranked in a manner similar to Evaluation 7. Results are shown in the following Table 10:

TABLE 9

Image density after copy of white document (Di-30 Copying machine) (in order of N/N, H/H, L/L)

| | Carrier | Initial | | | 10 K | | | 50 K | | | 100 K | | | 150 K | | | 200 K | | | 250 K | | | 300 K | | |
|---|---|---|---|---|---|---|---|---|---|---|---|---|---|---|---|---|---|---|---|---|---|---|---|---|---|
| Example 1 | A | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ |
| Example 2 | B | ○ | ○ | ○ | ○ | ○ | ○ | ○ | ○ | ○ | ○ | ○ | ○ | ◎ | ◎ | ◎ | ◎ | ◎ | ◎ | ◎ | ◎ | ◎ | ◎ | ◎ | ◎ |
| Example 3 | C | ○ | ○ | Δ | ○ | ○ | ○ | ○ | ○ | ○ | ○ | ○ | ○ | ○ | ○ | ○ | ○ | ○ | ○ | ○ | ○ | ○ | ○ | ○ | ○ |
| Example 4 | D | ○ | ○ | Δ | ○ | ○ | ○ | ○ | ○ | ○ | ○ | ○ | ○ | ○ | ○ | ○ | ◎ | ◎ | ◎ | ◎ | ◎ | ◎ | ◎ | ◎ | ◎ |
| Example 5 | E | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ |
| Example 6 | F | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ |
| Example 7 | G | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ |
| Example 8 | H | ○ | ○ | Δ | ○ | ○ | ○ | ○ | ○ | ○ | ○ | ○ | ○ | ○ | ○ | ○ | ○ | ○ | ○ | ◎ | ◎ | ◎ | ◎ | ◎ | ◎ |
| Example 9 | I | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ |
| Example 10 | J | ○ | ○ | ○ | ○ | ○ | ○ | ○ | ○ | ○ | ○ | ○ | ○ | ◎ | ◎ | ◎ | ◎ | ◎ | ◎ | ◎ | ◎ | ◎ | ◎ | ◎ | ◎ |
| Example 11 | K | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ |
| Comparative Example 1 | L | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ |
| Comparative Example 2 | M | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ |
| Comparative Example 3 | N | Δ | Δ | x | Δ | Δ | Δ | Δ | Δ | Δ | Δ | Δ | Δ | Δ | Δ | Δ | Δ | Δ | Δ | Δ | Δ | Δ | Δ | Δ | Δ |
| Comparative Example 4 | O | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ | ◎ |

TABLE 10

Image density after copy of white document (CF-70 Copying machine) (in order on N/N, H/H, L/L)

| | Carrier | Initial | | | 10 K | | | 50 K | | | 100 K | | | 150 K | | |
|---|---|---|---|---|---|---|---|---|---|---|---|---|---|---|---|---|
| Example 12 | A | ◎ | ◎ | ◎ | ◎ | ◎ | ◎ | ◎ | ◎ | ◎ | ◎ | ◎ | ◎ | ◎ | ◎ | ◎ |
| Example 13 | B | ○ | ○ | ○ | ○ | ○ | ○ | ○ | ○ | ○ | ◎ | ◎ | ◎ | ◎ | ◎ | ◎ |
| Example 14 | C | ○ | ○ | Δ | ○ | ○ | ○ | ○ | ○ | ○ | ○ | ○ | ○ | ○ | ○ | ○ |
| Example 15 | D | ○ | ○ | Δ | ○ | ○ | ○ | ○ | ○ | ○ | ◎ | ◎ | ◎ | ◎ | ◎ | ◎ |
| Example 16 | E | ◎ | ◎ | ◎ | ◎ | ◎ | ◎ | ◎ | ◎ | ◎ | ◎ | ◎ | ◎ | ◎ | ◎ | ◎ |
| Example 17 | F | ◎ | ◎ | ◎ | ◎ | ◎ | ◎ | ◎ | ◎ | ◎ | ◎ | ◎ | ◎ | ◎ | ◎ | ◎ |
| Example 18 | G | ◎ | ◎ | ◎ | ◎ | ◎ | ◎ | ◎ | ◎ | ◎ | ◎ | ◎ | ◎ | ◎ | ◎ | ◎ |
| Example 19 | H | ○ | ○ | Δ | ○ | ○ | ○ | ○ | ○ | ○ | ◎ | ◎ | ○ | ◎ | ◎ | ◎ |
| Example 20 | I | ◎ | ◎ | ◎ | ◎ | ◎ | ◎ | ◎ | ◎ | ◎ | ◎ | ◎ | ◎ | ◎ | ◎ | ◎ |
| Example 21 | J | ○ | ○ | ○ | ○ | ○ | ○ | ○ | ○ | ○ | ◎ | ◎ | ◎ | ◎ | ◎ | ◎ |
| Example 22 | K | ◎ | ◎ | ◎ | ◎ | ◎ | ◎ | ◎ | ◎ | ◎ | ◎ | ◎ | ◎ | ◎ | ◎ | ◎ |
| Comparative Example 5 | L | ◎ | ◎ | ◎ | ◎ | ◎ | ◎ | ◎ | ◎ | ◎ | ◎ | ◎ | ◎ | ◎ | ◎ | ◎ |
| Comparative Example 6 | M | ◎ | ◎ | ◎ | ◎ | ◎ | ◎ | ◎ | ◎ | ◎ | ◎ | ◎ | ◎ | ◎ | ◎ | ◎ |

TABLE 10-continued

| Image density after copy of white document (CF-70 Copying machine) (in order on N/N, H/H, L/L) | | | | | | | | | | | | | | | |
|---|---|---|---|---|---|---|---|---|---|---|---|---|---|---|---|
| | Carrier | Initial | | | 10 K | | | 50 K | | | 100 K | | | 150 K | |
| Comparative Example 7 | N | Δ | Δ | x | Δ | Δ | Δ | Δ | Δ | Δ | Δ | Δ | Δ | Δ | Δ |
| Comparative Example 8 | O | ⊙ | ⊙ | ⊙ | ⊙ | ⊙ | ⊙ | ⊙ | ⊙ | ⊙ | ⊙ | ⊙ | ⊙ | ⊙ | ⊙ |

The present invention successfully provided a carrier which is superior in the charge stability even after a long-time use and which causes no problems such as fogs and toner scattering. Moreover, the carrier of the present invention makes it possible to readily charge toner sufficiently.

What is claimed is:

1. A binder carrier comprising:

magnetic particles; and a binder resin comprising a thermoplastic silicone-modified acrylic resin and an amino-group-containing resin, wherein the magnetic particles are dispersed in the binder resin.

2. The binder carrier of claim 1, wherein the silicone-modified acrylic resin is a copolymer of a polydiorganosiloxane macromer having an acrylic functional group with a radical polymerizable organic monomer.

3. The binder carrier of claim 2, wherein the polydiorganosiloxane macromer is polydiorganosiloxane represented by the following formula:

(1)

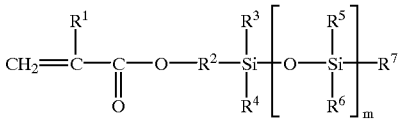

in which $R^1$ represents a hydrogen atom or an alkyl group; $R^2$ represents an alkylene group; $R^3$ to $R^6$ represent monovalent hydrocarbon groups independently; R7 is a group selected from the group consisting of a monovalent hydrocarbon group, a hydroxyl group and an acrylic functional group represented by the following formula:

(2)

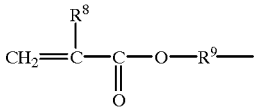

in which $R^8$ represents a hydrogen atom or an alkyl group; $R^9$ represents an alkylene group; and m is an integer from 1 to 500.

4. The binder carrier of claim 2, wherein the radical polymerizable organic monomer is an acrylic organic monomer represented by the following formula:

(9)

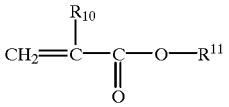

in which $R^{10}$ represents a hydrogen atom or an alkyl group; and $R^{11}$ represents a monovalent hydrocarbon group.

5. The binder carrier of claim 1, wherein the silicone-modified acrylic resin comprises a copolymer of a polydiorganosiloxane macromer having an acrylic functional group with a radical polymerizable organic monomer, and polyorganosiloxane.

6. The binder carrier of claim 1, wherein the silicone-modified acrylic resin has a softening point of 120 to 250° C.

7. The binder carrier of claim 1, wherein the silicone-modified acrylic resin is contained in an amount of 3 to 90 wt % relative to the binder resin.

8. The binder carrier of claim 1, wherein the amino-group-containing resin is a copolymer of a radical polymerizable monomer having an amino group and a radical polymerizable monomer.

9. The binder carrier of claim 8, wherein the radical polymerizable monomer having an amino group is an amino-group-containing monomer represented by the following formula:

(11)

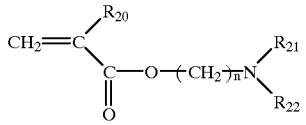

in which $R^{20}$ represents a hydrogen atom or an alkyl group; $R^{21}$ and $R^{22}$ independently represent an alkyl group; and n is an integer from 1 to 5.

10. The binder carrier of claim 8, wherein the radical polymerizable monomer is at least one monomer selected from the group consisting of styrene, a styrene derivative, alkyl acrylate and alkyl methacrylate.

11. The binder carrier of claim 1, wherein the amino-group-containing resin is a copolymer among a radical polymerizable monomer having an amino group, at least one styrene monomer selected from the group consisting of styrene and a styrene derivative, and at least one acrylic monomer selected from the group consisting of alkyl acrylate and alkyl methacrylate.

12. The binder carrier of claim 1, wherein the amino-group-containing resin has an amine value of 0.3 to 40 KOHmg/g, a softening point of 120 to 140° C. and a glass transition point of 60 to 80° C.

13. The binder carrier of claim 1, wherein the amino-group-containing resin has an amine value of 0.5 to 36 KOHmg/g, a softening point of 125 to 135° C. and a glass transition point of 65 to 75° C.

14. The binder carrier of claim 1, wherein the amino-group-containing resin is contained in an amount of 1 to 80 wt % relative to the binder resin.

15. The binder carrier of claim 1, wherein the binder resin contains at least one resin selected from the group consisting of a polyester resin, a styrene-acrylic copolymer resin, a poly(metha)acrylic resin, and an epoxy resin.

16. The binder carrier of claim 1, wherein the magnetic particles have an average primary particle size of not more than 5 μm and are contained in an amount of 100 to 900 parts by weight with respect to the binder resin of 100 parts by weight.

17. The binder carrier of claim 1, having a volume-average particle size of 20 to 100 $\mu$m and a saturated magnetization of 30 to 80 emu/g.

18. A developer comprising:

a toner; and a carrier comprising magnetic particles and a binder resin comprising a thermoplastic silicone-modified acrylic resin and an amino-group-containing resin, wherein the magnetic particles are dispersed in the binder resin.

19. The developer of claim 18, wherein the silicone-modified acrylic resin is a copolymer of a polydiorganosiloxane macromer having an acrylic functional group with a radical polymerizable organic monomer.

20. The developer of claim 18, wherein the amino-group-containing resin is a copolymer of a radical polymerizable monomer having an amino group with a radical polymerizable monomer.

* * * * *